US006299078B1

(12) United States Patent
Fugere

(10) Patent No.: US 6,299,078 B1
(45) Date of Patent: Oct. 9, 2001

(54) DISPENSE TIP ADAPTER FOR FLUID PUMP

(75) Inventor: Jeffrey Fugere, Sandown, NH (US)

(73) Assignee: Bradford Labs LLC, Haverhill, MA (US)

( * ) Notice: Subject to any disclaimer, the term of this patent is extended or adjusted under 35 U.S.C. 154(b) by 0 days.

(21) Appl. No.: 09/572,513

(22) Filed: May 17, 2000

Related U.S. Application Data

(63) Continuation of application No. 09/491,615, filed on Jan. 26, 2000.

(60) Provisional application No. 60/117,201, filed on Jan. 26, 1999, provisional application No. 60/163,938, filed on Nov. 8, 1999, provisional application No. 60/186,783, filed on Mar. 3, 2000, and provisional application No. 60/163,952, filed on Nov. 8, 1999.

(51) Int. Cl.[7] ..... B05B 1/00

(52) U.S. Cl. ..... 239/591; 239/596; 239/200

(58) Field of Search ..... 239/596, 600, 239/135, 302, 591; 285/24, 27, 390; 403/13; 222/326, 327, 567

(56) References Cited

U.S. PATENT DOCUMENTS

| | | | | |
|---|---|---|---|---|
| 5,236,227 | * | 8/1993 | Adams et al. | 285/27 |
| 5,366,312 | * | 11/1994 | Raines | 406/13 |
| 5,401,062 | * | 3/1995 | Vowles | 285/24 |
| 5,636,796 | * | 6/1997 | Oguma | 239/596 |
| 5,685,485 | * | 11/1997 | Mock et al. | 239/596 |

* cited by examiner

*Primary Examiner*—David A. Scherbel
*Assistant Examiner*—Davis Hwu
(74) *Attorney, Agent, or Firm*—Mills & Onello LLP

(57) ABSTRACT

In a dispense tip adapter system, an adapter unit provides for compatibility between high-performance dispensing needles and conventional dispensing pump systems. The dispensing pump includes an outlet through which dispensed material is delivered, and includes an output body with alignment pins extending therefrom and first threads about the body. The dispensing needle includes a longitudinally-disposed body and neck, the body and neck including a longitudinal port providing a path for delivery of the dispensed material through the dispensing needle. The body of the dispensing needle includes an outer surface that is keyed for angular positioning of the needle with respect to the pump. The adapter includes an alignment plate, and index plate and an adapter nut. The alignment plate comprises a plurality of alignment holes for mating with the alignment pins, a material aperture aligned with the pump outlet, and a plurality of index pins extending from the body of the alignment plate. The index plate comprises a plurality of index holes for mating with the index pins, the index holes spaced to provide for positioning of the index plate with respect to the alignment plate at a plurality of discrete angular positions. The index plate includes an orientation pocket having a keyed inner surface substantially matched to the outer surface of the body of the dispensing needle. The nut has an inner recess for containing the index plate and the alignment plate, and further includes a pin aperture in alignment with the orientation pocket and second threads for mating with the first threads. When the nut is tightened, index plate and alignment plate are secured against the pump output body.

12 Claims, 6 Drawing Sheets

DISPENSE TIP ADAPTER FOR FLUID PUMP

RELATED APPLICATIONS

This application claims benefit to U.S. Provisional Application No. 60/117,201, filed Jan. 26, 1999; U.S. Provisional Application No. 60/163, 938, filed Nov. 8, 1999; which is a continuation of U.S. patent application Ser. No. 09/491,615, filed Jan. 26, 2000; U.S. Provisional Application No. 60/186, 783, filed Mar. 3, 2000 and U.S. Provisional Application No. 60/163,952, filed Nov. 8, 1999; the contents of which are incorporated herein by reference, in their entirety.

BACKGROUND OF THE INVENTION

Contemporary fluid dispense systems are well suited for dispensing precise amounts of fluid at precise positions on a substrate. A pump transports the fluid to a dispense tip, also referred to as a "pin" or "needle", which is positioned over the substrate by a micropositioner, thereby providing patterns of fluid on the substrate as needed. As an example application, fluid delivery systems can be utilized for depositing precise volumes of adhesives, for example, glue, resin, or paste, during a circuit board assembly process, in the form of dots for high-speed applications, or in the form of lines for providing underfill or encapsulation.

Contemporary dispensing pumps comprise a syringe, a feed tube, a dispense cartridge, and pump drive mechanism. The syringe contains fluid for dispensing, and has an opening at its distal end at which a feed tube is connected. The feed tube is a flexible, hollow tube for delivering the fluid to the cartridge. The cartridge is hollow and cylindrical and includes an inlet neck at which the opposite end of the feed tube is connected. The inlet neck directs the fluid into the hollow, central cartridge chamber.

A feed screw disposed longitudinally through the center of the cylindrical chamber transports the fluid in Archimedes principle fashion from the inlet to a dispensing needle attached to the chamber outlet. A continuously-running motor drives the feed screw via a rotary clutch, which is selectively actuated to engage the feed screw and thereby effect dispensing. A bellows linkage between the motor and cartridge allows for flexibility in system alignment.

Pump systems can be characterized generally as "fixed-z" or "floating-z" (floating-z is also referred to as "compliant-z". Fixed-z systems are adapted for applications that do not require contact between the dispense tip and the substrate during dispensing. In fixed-z applications, the dispense tip is positioned and suspended above the substrate by a predetermined amount, and the fluid is dropped onto the substrate from above. In floating-z applications, the tip is provided with a standoff, or "foot", designed to contact the substrate as fluid is delivered by the pump through the tip. Such floating-z systems allow for tip travel, relative to the pump body, such that the entire weight of the pump does not bear down on the substrate.

Pump manufacturers commonly include their own custom interface for mounting dispense needles to the pumps. Customers investing a great deal of resources in a particular pump system are therefore limited to purchasing compliant dispense needles directly from the pump manufacturers. This arrangement is not optimal for the customer, since after-market dispensing needles are often times superior in performance and reliability. For example, the dispense needles disclosed in U.S. patent application Ser. No. 09/491, 615, filed Jan. 26, 2000, incorporated herein by reference, offer the capability of precise dispensing at higher throughput rates, higher reliability, and reduced dispensing widths.

Such high-performance dispense needles are incompatible with the current aforementioned manufacturer-specific systems.

SUMMARY OF THE INVENTION

The present invention is directed to an adapter that affords compatibility between high-performance dispensing needles and conventional pump systems.

In a first aspect, the present invention is directed to an adapter for securing a dispensing needle to a dispensing pump. The dispensing pump includes an outlet through which dispensed material is delivered, and includes an output body with alignment pins extending therefrom and first threads about the body. The dispensing needle includes a longitudinally-disposed body and neck, the body and neck including a longitudinal port providing a path for delivery of the dispensed material through the dispensing needle. The body of the dispensing needle includes an outer surface that is keyed for angular positioning of the needle with respect to the pump. The adapter includes an alignment plate, and index plate and an adapter nut. The alignment plate comprises a plurality of alignment holes for mating with the alignment pins, a material aperture aligned with the pump outlet, and a plurality of index pins extending from the body of the alignment plate. The index plate comprises a plurality of index holes for mating with the index pins, the index holes spaced to provide for positioning of the index plate with respect to the alignment plate at a plurality of discrete angular positions. The index plate further includes an orientation pocket having a keyed inner surface substantially matched to the outer surface of the body of the dispensing needle. The nut has an inner recess for containing the index plate and the alignment plate, and further includes a pin aperture in alignment with the orientation pocket and second threads for mating with the first threads. When the nut is tightened, index plate and alignment plate are secured against the pump output body.

The material aperture of the alignment plate preferably comprises a tapered funnel. The alignment holes are preferably positioned on opposite sides of the aperture. The alignment plate and index plate are preferably substantially disk-shaped. The index holes are preferably spatially positioned in a circular array about the orientation pocket, for example at 45 degree increments about the orientation pocket.

The inner surface of the orientation pocket may be substantially cylindrical and the keyed inner surface thereof may comprises a flat surface formed in the cylindrical inner surface such that the dispense needle has a single orientation with respect to the index plate.

An adapter kit may be provided comprising the adapter, a compartmentalized receptacle, dispense tip inspection accessories, dispense tip cleaning accessories, and dispense tip handling accessories.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
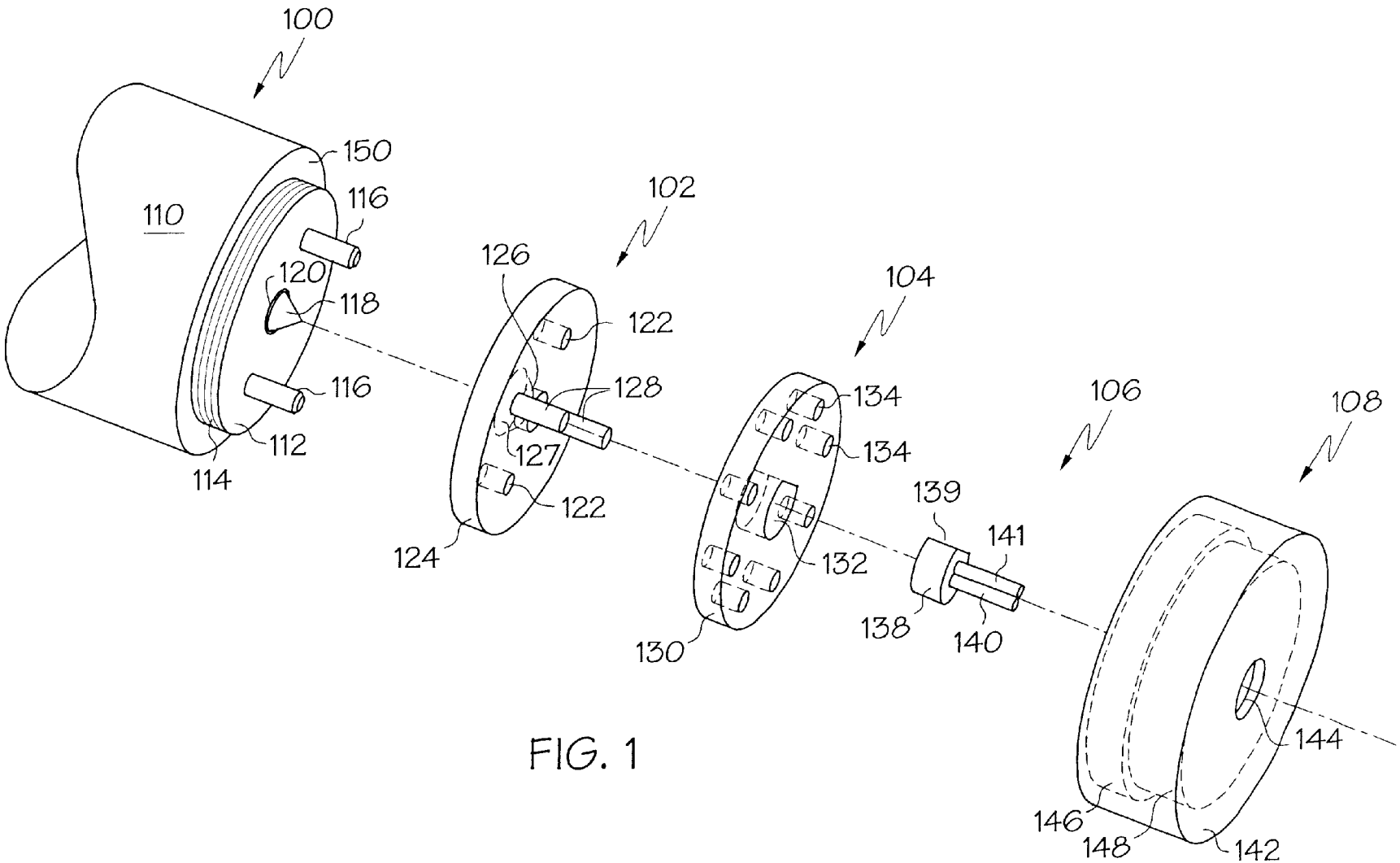
FIG. 1 is an exploded perspective view of an adapter configuration in accordance with the present invention.

FIG. 1 is an exploded perspective view of an adapter configuration in accordance with the present invention. The configuration includes a standard pump 100, a high-performance dispensing needle 106, and an adapter comprised of an alignment plate 102, an index plate 104 and an adapter nut 108. The adapter provides for compatibility between the otherwise incompatible pump interface 100 and high-performance dispensing needle 106.

The pump 100 includes, for example, a conical pump body 110 and an outlet face 150. The outlet face 150 includes a pump outlet aperture 120 at which the pump feed screw 118 releases material into the dispensing needle 106. The feed screw 118 may have a conical release end as shown in FIG. 1, or may have a flat release end, depending on the pump application.

The outlet face 150 further includes a raised body 112 having threads 114 about its outer perimeter and longitudinally-extending alignment pins 116. The alignment pins 116 are designed for mating with holes formed in a mounting plate for a standard dispensing needle, the dispensing needle 106 being laterally fixed in position with respect to the pump body 110 by a mounting nut 108 meshing with the threads 114. Such a standard mounting plate is however incompatible with high-performance dispensing needles, as described above. The adapter of the present invention overcomes this limitation by including an adapter including an alignment plate 102 and an index plate 104.

Figure 3C:
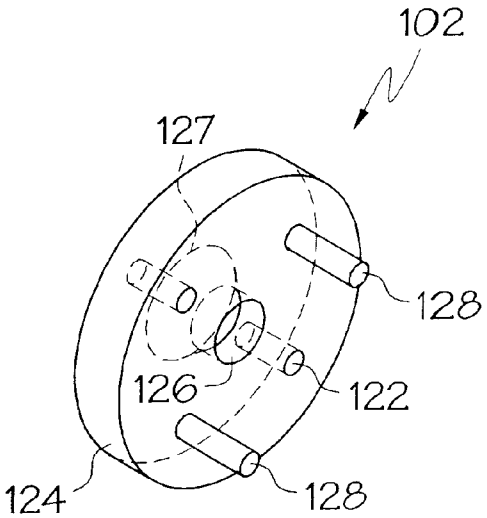
FIGS. 3A, 3B and 3C are front, side and perspective views respectively of an alignment plate in accordance with the present invention.
Figure 3B:
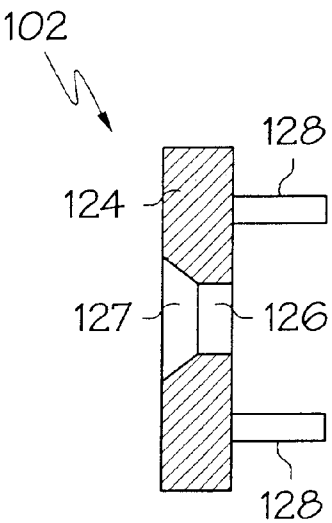
Figure 3A:
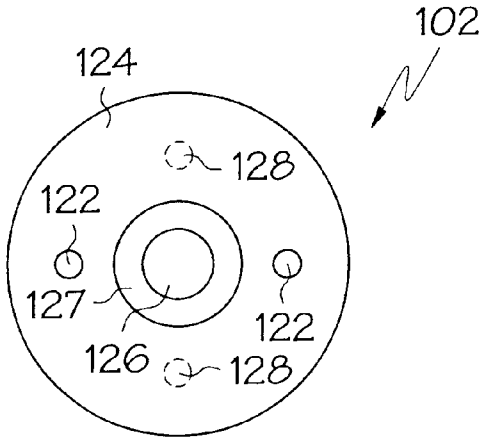

With reference to the front, side, and perspective views of FIGS. 3A, 3B, and 3C respectively, the alignment plate 102 includes holes 122 configured to communicate with the alignment pins 116 of the raised body 112 of the pump outlet face 150. The holes 122 are preferably slightly larger in diameter than the outer diameter of the alignment pins 116, thereby ensuring easy mounting to, and removal from, the pump, yet not so large as to allow for radial play in the alignment plate 102 with respect to the pump 100. A plurality of alignment pins 116 (for example at least two) and corresponding holes 122 are preferred to laterally fix the alignment plate 102 in position with respect to the pump 100.

The alignment plate 102 further includes a central aperture 126 to allow for material flow through the alignment plate 102 into the dispensing needle. The aperture 126 is preferably wide so as not to constrict material flow, yet is not so wide as to permit material flow about the body of the needle. For a pump system that includes a conical auger screw end 118, as shown in FIG. 1, the aperture 126 further includes a funnel feature 127 configured to correspond with the profile of the auger screw end 118. This configuration reduces the likelihood of material pooling between the auger screw 118 and the dispensing needle inlet.

The alignment plate 102 further includes a plurality of indexing pins 128 (for example at least two) extending from a surface at opposite ends of the aperture 126 as shown in FIGS. 3B and 3C. The indexing pins 128 mate with corresponding holes 134 on the index plate 104, as described below.

Since the aperture 126 of the alignment plate 102 comes in contact with dispensed material, the plate 102 preferably comprises a material that is compatible with many different dispensed material, and avoids tarnishing or deterioration. Example materials include 303 stainless steel.

Figure 4C:
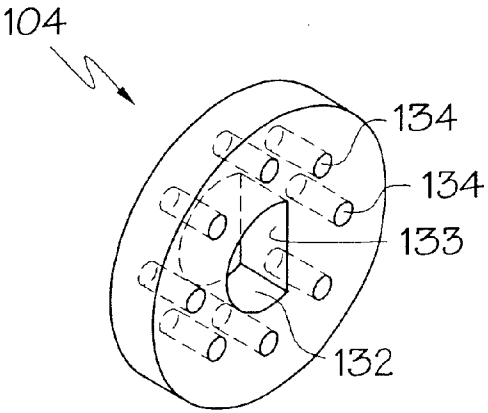
FIGS. 4A, 4B and 4C are front, side and perspective views respectively of an index plate in accordance with the present invention.
Figure 4B:
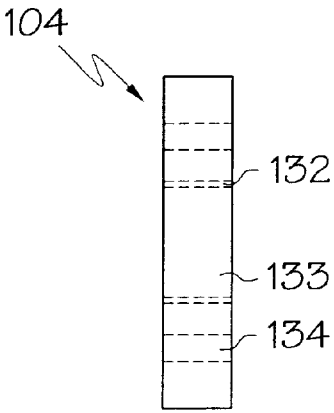
Figure 4A:
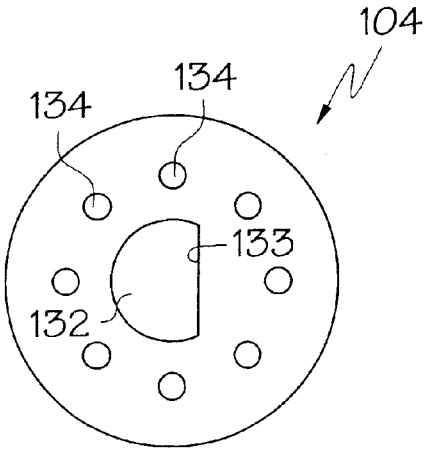

With reference to the front side, and perspective views of FIGS. 4A, 4B, and 4C respectively, the index plate 104 includes an array of holes 134 configured to communicate with the indexing pins 128 extending from the alignment plate 102. The holes 134 are arranged to allow for a plurality of angular mounting orientations of the index plate 104 with respect to the alignment plate 102. The index plate 104 further includes an orientation pocket 132, within which the body 138 (see FIG. 1) of the high-performance dispensing needle 106 is positioned. The outer surface of the body 138 of the dispensing needle is generally cylindrical in shape, and further includes a keying feature, for example a flat face 139 on one side of the body as shown in FIG. 1 to ensure proper orientation of the dispensing needle 106 with respect to the pump 100 when seated. Orientation is especially important for needles that are asymmetric, for example needles in which the outlet neck 140 is not positioned in the center of the needle body. Orientation is also important for needles that include a dispensing foot 141 for making contact with the substrate, as certain applications require the foot 141 to be in a specific orientation with respect to the neck 141 duriing a dispensing operation. For this reason, the orientation pocket 132 of the present invention includes a corresponding keying feature in the form of a flat face 133 matched to the keying feature 139 of the dispensing needle body 139. While a keying feature in the form of a flat surface cut from a cylindrical body is shown and described, other keying features are equally applicable to the present invention.

Together, the keyed orientation pocket 132 and the array of holes 134 provide for a mounting arrangement that permits a plurality of angular orientations of the mounted dispensing needle 106 with respect to the alignment plate 102. For example, assuming dual indexing pins 128 and eight equally-spaced orientation holes 134, eight angular orientations of the dispensing needle 106 are possible, at 45 degree increments.

The adapter plate 104 is preferably formed of a material that is readily machinable, and one that retains its geometry when under stress. A lubricated plastic material is preferred, for example Tercite™ material.

Figure 5B:
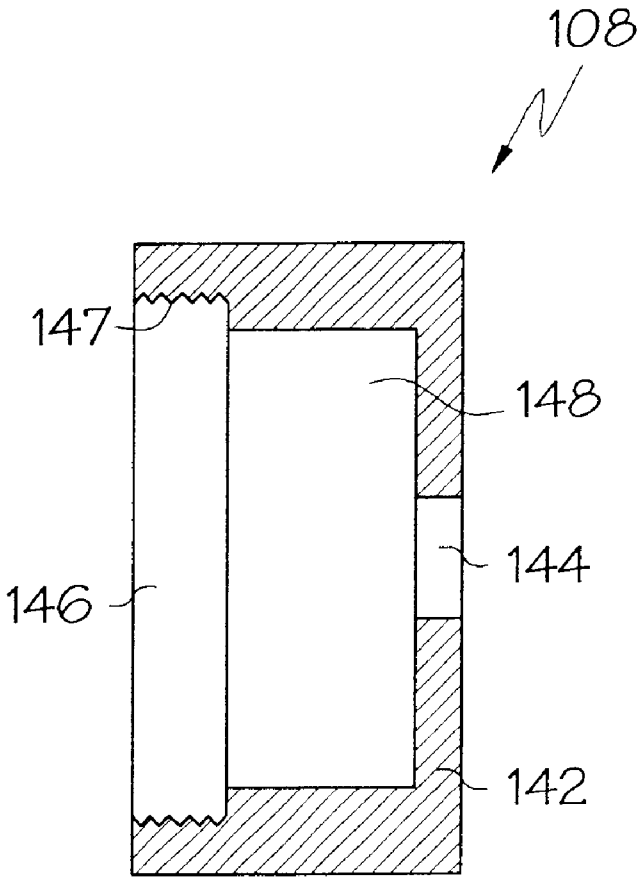
FIGS. 5A and 5B are front and side views respectively of an adapter nut in accordance with the present invention.
Figure 5A:
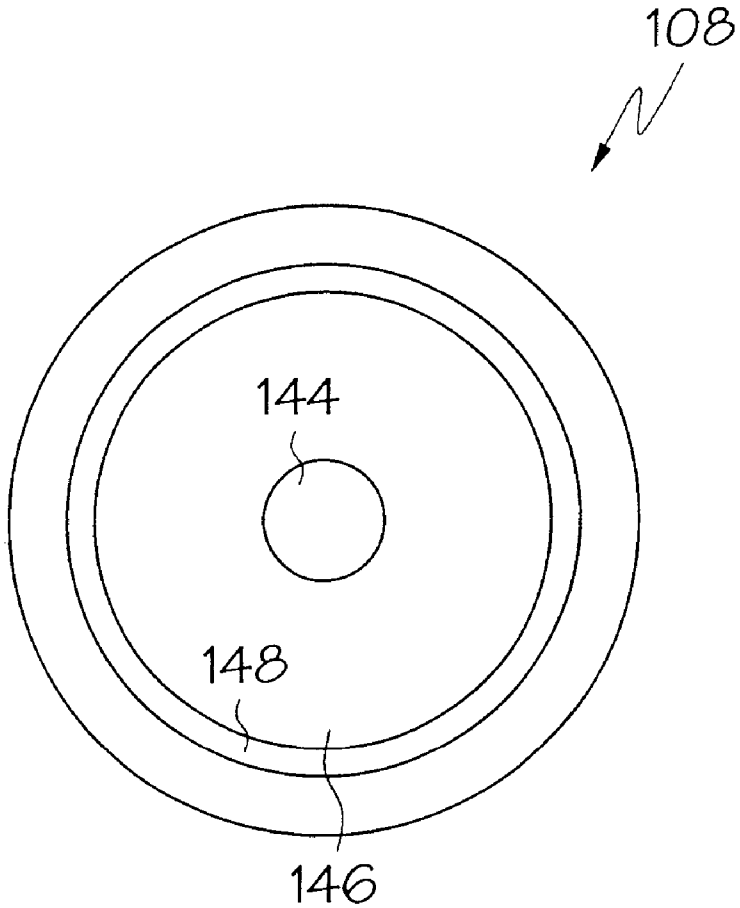

With reference to the front and cutaway side views of FIGS. 5A and 5B, the adapter nut 108 includes a hole 144 through which the neck 140 and foot 141 of the dispense needle extend. The inner diameter of the hole 144 is dimensioned smaller that the outer diameter of the body 138 of the dispensing needle, to prevent the body from slipping through the hole 144 when the nut is tightened.

Figure 2:
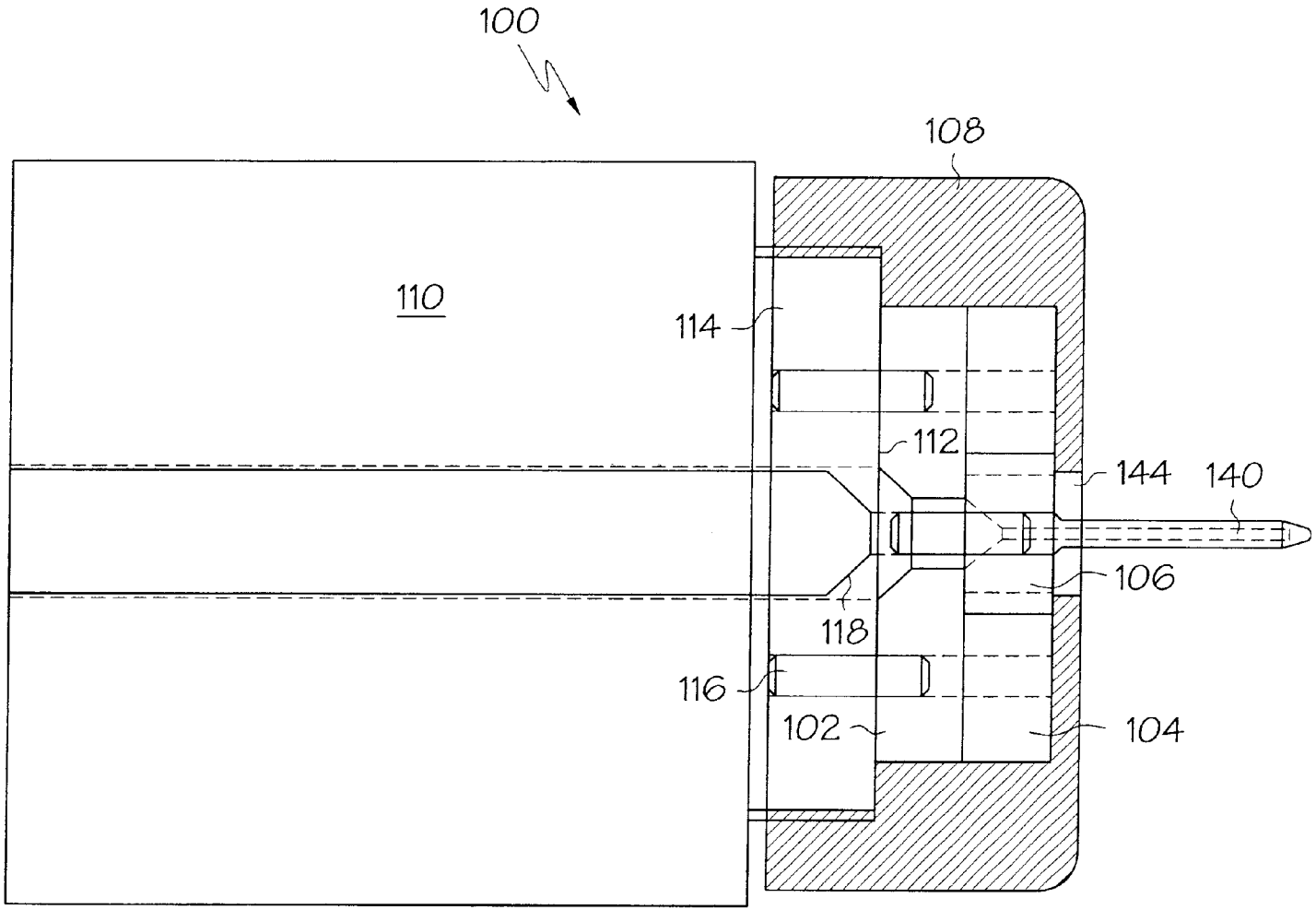
FIG. 2 is a partially cutaway side view of assembled adapter in accordance with the present invention.

The nut 108 further includes an inner recess 148 and an outer recess 146. The inner recess is dimensioned to enclose the alignment plate 102 and index plate 104. The outer recess is dimensioned to enclose the pump outlet face 112, and includes threads 147 that mate with the corresponding threads of the outlet face 112. When tightened, the nut 108 operates to secure the dispensing needle 106, the index plate 104 and the alignment plate 102 tightly against the outlet face 112 as shown in the cutaway side assembled view of FIG. 2. The nut 18 preferably has a knurled outer surface for handling ease and to provide purchase during tightening.

Figure 6:
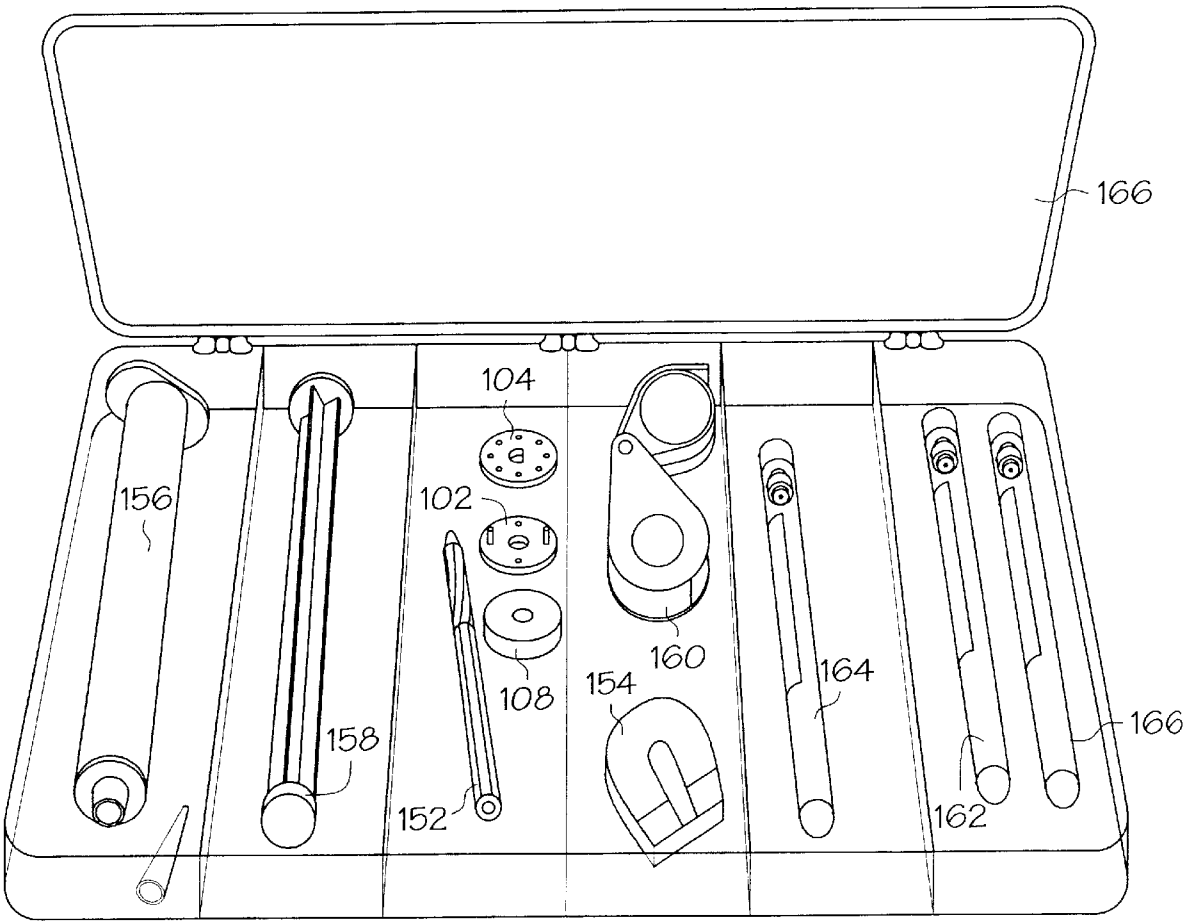
FIG. 6 is a perspective view of an adapter kit in accordance with the present invention.

In another aspect of the present invention, an adapter kit as shown in FIG. 6 is provided. Such a kit is preferably enclosed in a plastic, non-scratch compartmentalized receptacle 166, and includes a pin-vise 152, magnet 154, syringe 156 and plunger 158, magnifying glass 160, cleaning wires 162, cleaning tools 164, and the above-disclosed adapter including alignment plate 102, index plate 104 and adapter nut 108. Also included are an assortment of high-performance dispensing needles 166. The pin vise 152 is adapted to secure the miniature wires and drills during a dispense needle cleaning operation. The magnet 154 is helpful for locating the wires and drills on a work surface, for example by using a sweeping motion of the magnet over the surface. The syringe and plunger 156, 158 are provided for flushing out the dispense tips following cleaning with the wires and fluted drill bits. Alcohol is a preferred liquid for the flushing operation. A magnifying glass 160 helps with inspection of the dispense tips during, and following, cleaning. Cleaning wires 162 include cleaning wires with tapered ends for eased insertion into the dispense tips. Cleaning tools 164 include fluted drill bits for coarse cleaning of the inner necks, and a shoveled cleaning tool, described above, for cleaning the inner taper of the high performance dispense tips.

While this invention has been particularly shown and described with reference to preferred embodiments thereof, it will be understood by those skilled in the art that various changes in form and detail may be made herein without departing from the spirit and scope of the invention as defined by the appended claims.

I claim:

1. An adapter for securing a dispensing needle to a dispensing pump, the dispensing pump having an outlet through which dispensed material is delivered, and having an output body with alignment pins extending therefrom and first threads about the body, the dispensing needle having a longitudinally-disposed body and neck, the body and neck including a longitudinal port providing a path for delivery of said dispensed material through the dispensing needle, the body having an outer surface that is keyed for angular positioning thereof, comprising:

an alignment plate comprising a plurality of alignment holes for mating with said alignment pins, a material aperture aligned with said pump outlet, and a plurality of index pins extending therefrom;

an index plate comprising a plurality of index holes for mating with said index pins, said index holes spaced to provide for positioning of said index plate with respect to said alignment plate at a plurality of discrete angular positions, said index plate further including an orientation pocket having a keyed inner surface substantially matched to the outer surface of the body of the dispensing needle; and a nut having an inner recess for containing said index plate and said alignment plate, the nut having a pin aperture in alignment with the orientation pocket and having second threads for mating with the first threads, which, when tightened, longitudinally secures the index plate and alignment plate against the pump output body.

2. The adapter of claim 1 wherein the material aperture of the alignment plate comprises a tapered funnel.

3. The adapter of claim 1 wherein the alignment holes are positioned on opposite sides of the aperture.

4. The adapter of claim 1 wherein the alignment plate is substantially disk-shaped.

5. The adapter of claim 1 wherein the index holes are spatially positioned in a circular array about the orientation pocket.

6. The adapter of claim 5 wherein the index holes are spaced at 45 degree increments about the orientation pocket.

7. The adapter of claim 1 wherein the inner surface of the orientation pocket is substantially cylindrical and wherein the keyed inner surface comprises a flat surface formed in the cylindrical inner surface such that the dispense needle has a single orientation with respect to the index plate.

8. The adapter of claim 1 wherein the index plate is substantially disk-shaped.

9. The adapter of claim 1 wherein the pin aperture is smaller in diameter than an outer diameter of the dispensing needle body.

10. The adapter of claim 1 wherein the nut has a knurled outer surface.

11. The adapter of claim 1 wherein the nut includes a first inner compartment for containing the index plate and the alignment plate and a second inner compartment having the second threads long its inner surface.

12. The adapter of claim 1 further comprising an adapter kit comprising a compartmentalized receptacle; dispense tip inspection accessories; dispense tip cleaning accessories; and dispense tip handling accessories.

* * * * *